US007204115B2

(12) United States Patent
Focken

(10) Patent No.: US 7,204,115 B2
(45) Date of Patent: Apr. 17, 2007

(54) AXIAL THREAD-ROLLING HEAD

(75) Inventor: Andreas Focken, Schwarzenbek (DE)

(73) Assignee: Fette GmbH, Schwarzenbek (DE)

( * ) Notice: Subject to any disclaimer, the term of this patent is extended or adjusted under 35 U.S.C. 154(b) by 144 days.

(21) Appl. No.: 11/002,668

(22) Filed: Dec. 3, 2004

(65) Prior Publication Data

US 2005/0150267 A1 Jul. 14, 2005

(30) Foreign Application Priority Data

Jan. 14, 2004 (DE) ..... 20 2004 000 424 U

(51) Int. Cl.
*B21H 3/04* (2006.01)

(52) U.S. Cl. ..... 72/103; 72/481.8

(58) Field of Classification Search ..... 72/103, 72/104, 108, 121, 478, 481.6, 481.7, 481.8
See application file for complete search history.

(56) References Cited

U.S. PATENT DOCUMENTS 2,704,950 A * 3/1955 Scott ..... 72/104
3,972,213 A * 8/1976 Habegger ..... 72/104
4,096,722 A * 6/1978 Torralba ..... 72/104
5,568,743 A * 10/1996 Oppelt ..... 72/121
5,870,918 A * 2/1999 Schunk et al. ..... 72/104
6,684,674 B2 * 2/2004 Focken ..... 72/121

FOREIGN PATENT DOCUMENTS

DE 1 269 086 5/1968
DE 24 38 937 3/1976
DE 44 30 184 A1 3/1995

* cited by examiner

*Primary Examiner*—Ed Tolan
(74) *Attorney, Agent, or Firm*—Clark & Brody

(57) ABSTRACT

An axial thread-rolling head comprising a shank and a bearing unit held by said shank and having the profiled rolling dies wherein said shank has an elongate gripping portion, a first clutch portion, a supporting portion for the bearing unit, and a driver portion for a central toothed gear of said bearing unit and said bearing unit has a second clutch portion which is in engagement with said first clutch portion when said bearing unit and said shank are in a coupled position because of a spring bias, and is out of engagement when said bearing unit and said shank are axially moved apart, against said spring bias, to a separating position, which allows said bearing unit to perform a relative rotation on said shank, wherein said gripping portion and said clutch portion, on one hand, and said supporting portion and said driver portion, on the other hand, define separate components which are axially fixed and fixed for rotation via connecting portions, but are adapted to be releasably connected to each other.

4 Claims, 1 Drawing Sheet

AXIAL THREAD-ROLLING HEAD

The invention relates to an axial thread-rolling head according to claim 1.

Axial thread-rolling heads have become known from DE 12 69 086 or DE 24 38 937 C3, for example. They usually provide three profiled rolling dies offset by 120° from each other which are rotatably supported by a so-called bearing unit. The bearing unit is held by a shank which is gripped in a machine tool. The thread-rolling head is held in place in the sense of rotation, but can move axially. The rolling head is pressed onto the rotating tool, the forward feed being performed by the rolling head, which is freely movable axially, while the thread is being formed. Upon completion of thread forming, it is necessary to bring the profiled rolling dies out of engagement with the workpiece. For this purpose, the profiled rolling dies are mounted on eccentric shafts on which small pinions are also seated which mesh with a central toothed gear which is fixedly mounted for rotation on the shank (DE 12 69 086 A1 or DE 44 30 184 C2). A spiral-coiled spring has one end fixedly connected to the bearing unit and has the other end fixedly connected to the shank. When the profiled rolling dies are in the working position the spiral-coiled spring is biased in the direction of the coil. When the feed motion reaches a predetermined value the workpiece hits against a bar which is axially supported in the shank of the thread-rolling head. This causes the bearing unit and shaft to be axially moved apart and a jaw clutch between these components to be disengaged. Now, the spring is capable of rotating the bearing unit through a predetermined angle. As a result, the gears roll along on the central toothed gear, thereby rotating the eccentric shafts to displace the profiled rolling dies to get out of engagement with the workpiece. The bearing unit is set back in the sense of rotation in opposition to the described rotational motion to tension the spiral-coiled spring and move the rolling dies towards each other until the claw clutch gets latch-engaged.

It is natural that the profiled rolling dies are designed for certain workpiece diameters and threads. If it is intended to work a different workpiece on the same machine tool it is natural that a different thread-rolling head must be used. This also applies to the case that the gripping portion of the shank needs to be adapted to a specific machine tool. According to the state of the art, the shank forms part of the thread-rolling head and cannot be readily removed unless the rolling head is dismounted.

It is the object of the invention to provide an axial thread-rolling head in which the manufacturing effort can be reduced although a multiplicity of thread-rolling heads require to be kept ready.

The object is achieved by the features of claim 1.

In the inventive axial thread-rolling head, the gripping portion of the shank, on one hand, and the clutch portion, supporting portion and driver portion, on the other hand, are separate components which are axially fixed and fixed for rotation via suitable connecting portions, but are adapted to be releasably connected to each other.

If a different shaft is to be used for a predetermined axial thread-rolling head it is possible to readily exchange the respective shank portion against a different one in the inventive rolling head, but the component connected to the bearing unit being is allowed to remain in the shank portion. If a plurality of thread-rolling heads are kept ready at a manufacturing works that are employed depending on their application the gripping portion may remain in the machine tool when the bearing unit is removed and is exchanged against a different one which is desired. If only one thread-rolling head each is employed in the machine tool only a single gripping shaft is required for a multiplicity of different rolling heads.

This considerably reduces the expenditure in manufacture and materials for the axial thread-rolling heads.

Various possible ways are conceivable to firmly connect the separated components of the shank to each other. In this regard, an aspect of the invention provides that the gripping portion has a cylindrical collar which can be fittingly introduced into a coaxial cylindrical recess of the clutch portion where a rear-sided radial annular face of said clutch portion bears against a radial stop face of said gripping portion. The clutch portion has radial, circumferentially spaced bores which lead into the cylindrical recess and receive the mounting screws. The axial collar has radial threaded holes to receive the threaded portion of the mounting screws. Hence, separating the components described merely requires to remove the mounting screws of which three are provided, for example. The radial surfaces which rest against each other have been worked accurately and determine the axial length of the shaft for which a certain measure has to be observed. According to another aspect of the invention, the bores and mounting screws are designed in such that the radial annular face and the radial stop face are clamped against each other while said mounting screws are being threaded in. For this purpose, the radial bores may be provided with an appropriate eccentric countersunk depression which interacts with conical portions of the mounting screws in order that an axial force be achieved between the separated components while being threaded in.

The invention will be described in more detail below with reference to an embodiment shown in the drawings.

The drawings merely illustrate the shank of an axial thread-rolling head where the typical construction of a thread-rolling head as was described already at the beginning is presumed to be known. In particular, reference is made to DE 44 30 184 C2 in which an exemplary thread-rolling head is described and illustrated.

Figure 1:
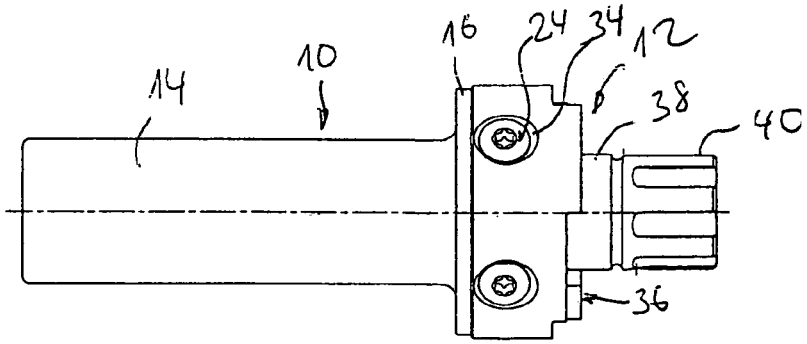
FIG. 1 shows a side view of a shank for an axial thread-rolling head according to the invention.
Figure 2:
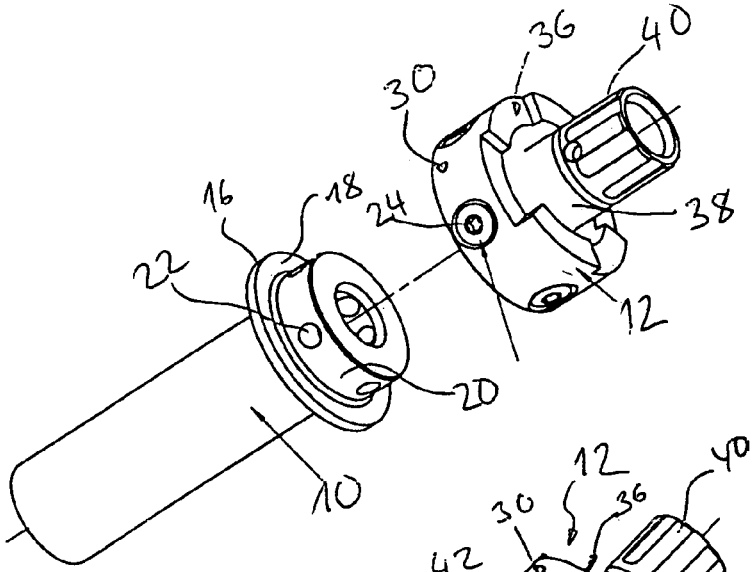
FIG. 2 is a perspective view of the shank of FIG. 1 in an exploded position.
Figure 3:
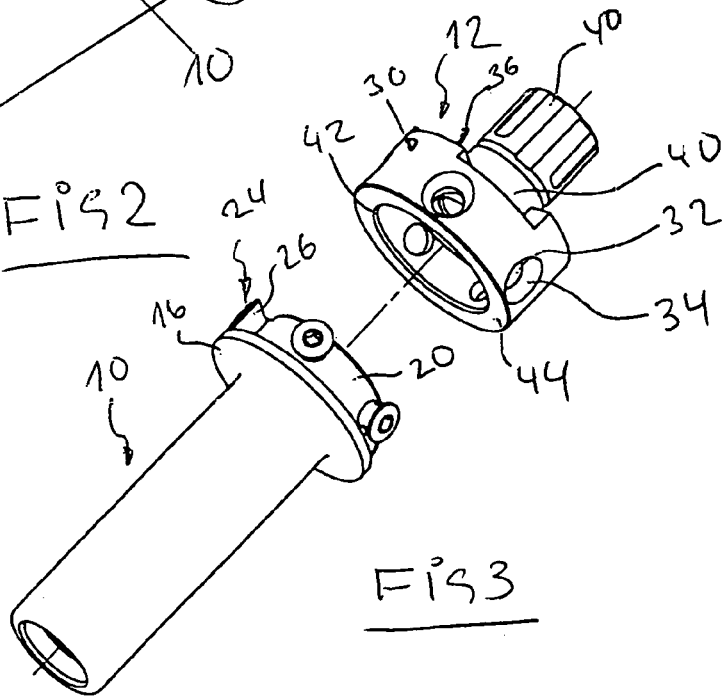
FIG. 3 is a representation similar to FIG. 2 which outlines the way of arranging the mounting screws in the gripping portion of the shank.

The shank illustrated in FIGS. 1 to 3 is composed of a first component 10 and a second component 12. The component 10 has an elongate cylindrical gripping portion 14 which has been bored through axially in a known manner. It serves for being gripped in an appropriate machine tool, the axial through bore being adapted to receive a stop against which the workpiece abuts to move apart the bearing unit, on one hand, and the shank, on the other. The front region of the gripping portion 14 has formed therein a radial flange 16 which defines a radial stop face 18. The stop face 18 is joined by an axial cylindrical collar 20 which exhibits four radial threaded holes 22 which are spaced by 90° each. As can be seen from FIG. 3 the threaded holes 22 are designed to receive mounting screws 24 the heads of which are conical as can be seen at 26. The portions described of the component 10 are integrally formed.

The component 12 has a hollow cylindrical portion 30 which is provided with radial through bores 32. The through bores 32 are arranged at a spacing of 90° and have a conical countersunk depression 34. As can be deduced from FIG. 3 the conical countersunk depression 34 is off-center. On the side opposed to the component 10, the portion 30 has a clutch portion 36 which is configured as a claw clutch portion here. The claw clutch portion 36 interacts with a complementary clutch portion of the bearing unit of the axial thread-rolling head. The bearing unit, on one hand, and the shank of FIGS. 1 to 3, on the other hand, are movable relative to each other to engage and disengage the clutch portions.

The bearing unit, which is not shown, is accommodated by a supporting portion 38 which joins the clutch portion 36. The supporting portion 38 is joined by a splined portion 40 which as is also known fixedly interacts for rotation with a complementary through bore of a central toothed gear which, in turn, meshes with pinions on the eccentric shafts for the profiled rolling dies of the axial thread-rolling head.

The component 12 is also integrally formed. During assembly, the collar 20 is inserted into the interior of the portion 30 with the inner recess 42 of the portion 30 being fittingly seated on the collar 20 and the axes of the bores 32 coinciding with the axes of the threaded holes 22. Subsequently, the mounting screws 24 are threaded into the threaded holes 22 via the bores 32. Since the countersunk depressions 34 with which the conical heads interact are off-center the configuration of the countersunk depressions 34 produces an axial force component between the components 10 and 12, which causes a rear-sided annular surface 44 of the portion 30 to be fixedly locked against the stop face 18 of the flange 16.

The component 12 normally is fixedly incorporated into the axial thread-rolling head that is not shown. If a different rolling head or different gripping portion is to be used this merely requires the removal of the mounting screws 24 to take the components apart.

The invention claimed is:

1. An axial thread-rolling head comprising a shank and a bearing unit held by said shank and having a profiled rolling dies wherein said shank has an elongate gripping portion, a first clutch portion, a supporting portion for the bearing unit, and a driver portion for a central toothed gear of said bearing unit and said bearing unit has a second clutch portion which is in engagement with said first clutch portion when said bearing unit and said shank are in a coupled position because of a spring bias, and is out of engagement when said bearing unit and said shank are axially moved apart, against said spring bias, to a separating position, which allows said bearing unit to perform a relative rotation on said shank, characterized in that said gripping portion defines a first component, and said clutch portion (36), said supporting portion (38) and said portion define a second component, the first and second components being separate from each other, and further being axially fixed and fixed for rotation via connection portions, and being adapted to be releasably connected to each other.

2. The axial thread-rolling head according to claim 1, characterized in that said gripping portion (10, 14) has a cylindrical collar (20) which can be fittingly introduced into a coaxial cylindrical recess (42) of said clutch portion (30, 36) wherein a rear-sided radial annular face (44) of said clutch portion (30, 36) bears against a radial stop face (18) of said gripping portion, said clutch portion (30, 36) has radial, circumferentially spaced bores (32) which receive mounting screws (24), and said axial collar (20) has radial threaded holes (22) to receive the threaded shaft of said mounting screws (24).

3. The axial thread-rolling head according to claim 2, characterized in that said radial bores (32) and said mounting screws (24) are designed in such a way that said radial annular face (44) and said radial stop face (18) are clamped against each other while said mounting screws (24) are being threaded in.

4. The axial thread-rolling head according to claim 3, characterized in that said radial bores (32) have an eccentric conical countersunk depression (34).

* * * * *